United States Patent [19]

Bridges

[11] 4,120,519

[45] Oct. 17, 1978

[54] COLLET TYPE CYLINDER SEPARATION DEVICE

[75] Inventor: Robert M. Bridges, Northridge, Calif.

[73] Assignee: The Bendix Corporation, North Hollywood, Calif.

[21] Appl. No.: 838,604

[22] Filed: Oct. 3, 1977

[51] Int. Cl.[2] ..... F16L 37/08

[52] U.S. Cl. ..... 285/3; 285/33; 285/319; 285/322; 285/410; 285/414; 285/DIG. 21

[58] Field of Search ..... 285/2, 3, 4, 322, 364, 285/367, 407, 408, 410, 411, 414, DIG. 21, 319, 33, 34, 35; 29/427; 403/2, 15, 31

[56] References Cited

U.S. PATENT DOCUMENTS

| | | | |
|---|---|---|---|
| 2,410,297 | 10/1946 | Mahlberg | 285/319 |
| 2,697,570 | 12/1954 | Snyder | 285/367 X |
| 2,996,316 | 8/1961 | Terhune | 285/4 |
| 3,131,635 | 5/1964 | Steinmetz et al. | 285/3 X |
| 3,215,082 | 11/1965 | Baggs et al. | 285/3 X |
| 3,253,653 | 5/1966 | Layne | 285/3 X |

*Primary Examiner*—Dave W. Arola

*Attorney, Agent, or Firm*—Robert C. Smith; William F. Thornton

[57] ABSTRACT

A readily separable fastening structure for holding a pair of cylindrical sections together in axial alignment includes annular rim members attached to the inside surfaces near the ends of the cylindrical members, one of which has an outwardly extending flange spaced from the end of its corresponding cylindrical member to form an annular groove and the other of which is adapted to telescope within the first such rim member, the other such rim member also including an inwardly extending flange. A plurality of spaced members having spring fingers are attached to the outside of the second cylindrical member and extending beyond the end thereof, the spring fingers each having an inwardly extending ridge and a groove on the outside of the ridge. A small diameter cable is positioned in said grooves, and tensioning members are included for pulling said cable tightly around said fingers to pull the inwardly extending ridges into said annular groove to lock said cylindrical members together. A pyro device is positioned to cut the cable to effect automated sequencing separation of the cylindrical members.

7 Claims, 6 Drawing Figures

COLLET TYPE CYLINDER SEPARATION DEVICE

The invention herein described was made in the course of or under a contract with the Navy Department.

BACKGROUND OF THE INVENTION

In the deployment of underwater sound sources and instrumentation, the object being deployed may consist of a cylindrical housing or member containing transducers, electronic gear, etc., to which is attached a second cylindrical housing or member of essentially the same diameter which may contain weights, batteries or flotation means including ropes or cables. Reliable automatic separation is necessary after deployment. The usual means for fastening such cylindrical sections together involves forming or attaching of a ring or ridge at the adjoining ends with a full circle type clamp which bridges across these rims or ridges and which may be tightened by a turnbuckle or similar fastening means. One such device which has been used extensively is the Vee Band clamp maufactured by Aeroquip Corporation. While such devices are entirely satisfactory in most instances, applicant has been confronted with an application wherein the diameter of the assembly closely approaches that of the airborne torpedo envelope in which the assembly is carried, severely limiting the space for such fastening means. In addition, certain longitudinal fin members bridge across the joint between the two cylindrical housings. There are three such fin members which are fastened to the lower cylinder and which (prior to release) are held in a restricted position tightly against the side of the upper housing member. With these fin members installed as described, a release band in the form of a continuous rigid structural circle of significant thickness becomes impractical. The deployment system for the particular sonar device for which the present invention was devised requires that this separation mechanism not significantly add to the overall diameter of the cylindrical housing snce the sonar is to be launched from a standard airborne torpedo envelope. In addition, the available standard types of coupling assemblies for this general application are smewhat expensive, and since the application for which the present separation device has been devised is for an expendable unit, minimum costs are highly desirable.

DESCRIPTION OF THE PREFERRED EMBODIMENT

The fastening structure described herein meets the problems set forth above in that it provides a reliable release, does not add excessively to the diameter of the assembly, and is efficient in avoiding undue stress concentrations which could require increasing the size and weight of parts. In quantity it becomes quite inexpensive.

Figure 1:
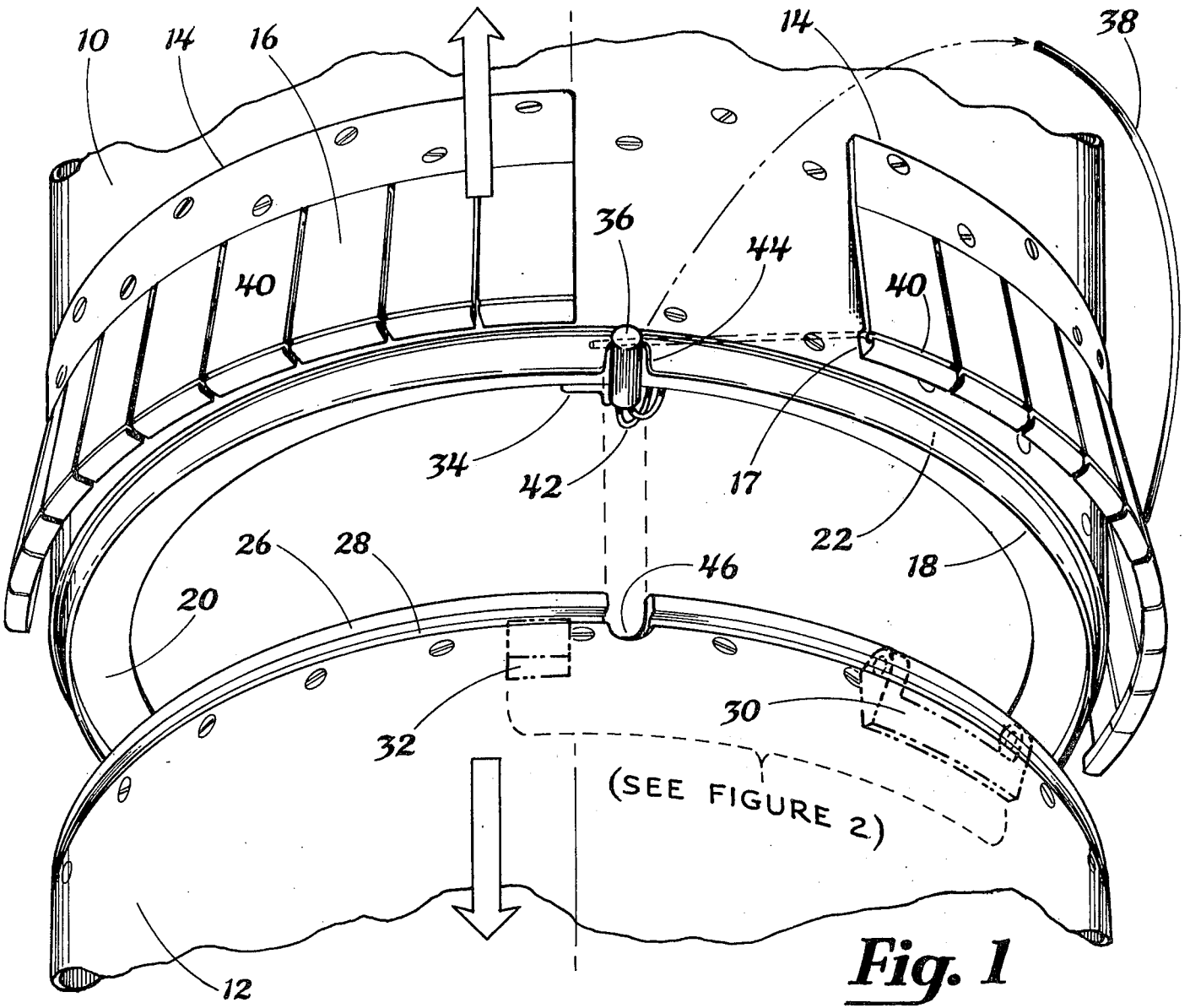
FIG. 1 is a perspective view of my fastening structure shown in association with two cylindrical members in the course of separating.

FIG. 1 shows an upper cylindrical member or housing 10 and a lower cylindrical member or housing 12 whic have been fastened together but are in the process of separation. As is shown by the arrows, these two parts are pictured moving in opposite directions relative to each other. The upper cylindrical member 10 has fastened to its exterior near one end thereof a plurality of arcuate members 14, each of which includes a significant number of axially extending spring fingers 16 which are normally biased outwardly away from the external surface of cylindrical member 10. In the particular configuration shown, it is contemplated that the spacing between the arcuate members 14 may be approximately 30°, and the arcuate members themselves will occupy approximately 90°, although other arrangements may be used depending upon requirements. The 30° spacing between members 14 is dictated by the requirement to leave space for three axially extending fin members (not shown) which bridge across the joint between members 10 and 12 and which are retained tightly against the sides of the cylindrical members until released. At the time of release, these fin members which are attached at their lower end to housing 12 will spring outwardly and serve to slow the descent of housing 12 in the water. Since both of housing members 10 and 12, the fastening means therefor, and the axially extending fins must be accommodated within a diameter only slightly larger than that of the housing members themselves, it will be appreciated that the fastening means for securing cylindrical housing members 10 and 12 together cannot have substantial thickness, particularly for the entire circumference of the housing members.

Figure 2A:
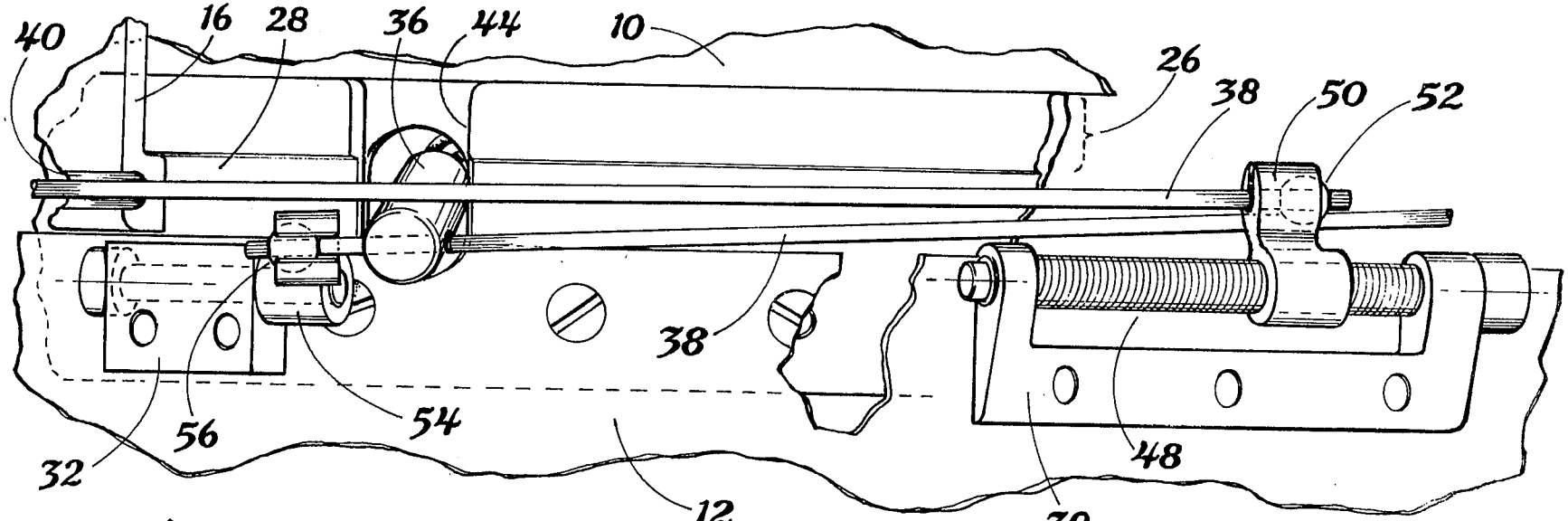
FIG. 2*a* is a fragmentary plan view showing detail of part of the fastening structure of FIG. 1.
Figure 2B:
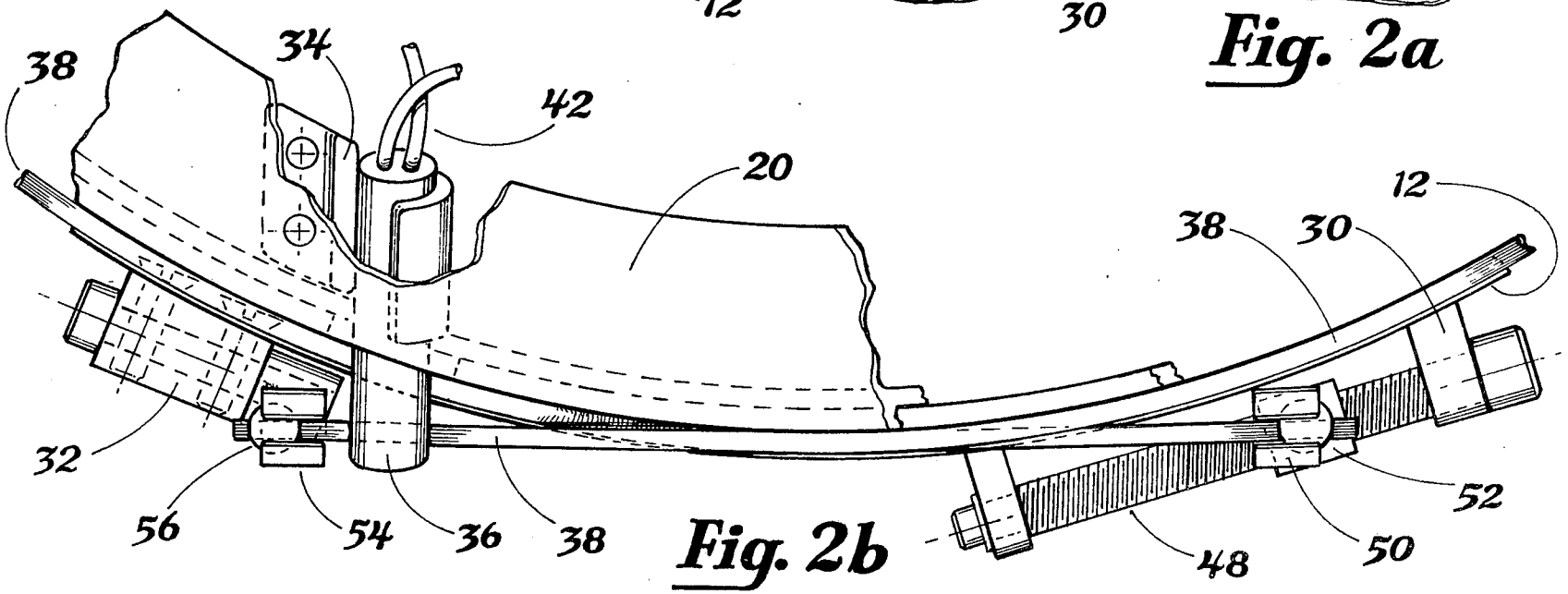
FIG. 2*b* is a fragmentary plan view showing detail of another part of the fastening structure of FIG. 1.

Fastened to the inner wall of cylindrical member 10 is a cylindrical ring member 18 having a roughly "L"-shaped cross-section, one leg of which is a radially inwardly extending bulkhead 20 and the other of which extends axially beyond the end of housing 10 to a distance just short of that of the end of the spring fingers 16. (See FIG. 3.) Near the end of the cylindrical member 12 on the inside thereof is attached a rim or flange member 24 which extends a significant distance beyond the end of housing 12 and which has an outwardly extending flange 26 which is spaced from the end of housing 12 in such manner as to leave an annular groove 28. Attached to the side of housing 12 near its upper end are a pair of brackets 30 and 32 whose function is to provide supporting structure for the tensioning means used to secure housing members 10 and 12 together. This structure is shown in detail in FIGS. 2*a* and 2*b*.

Figures 3, 4, 5:
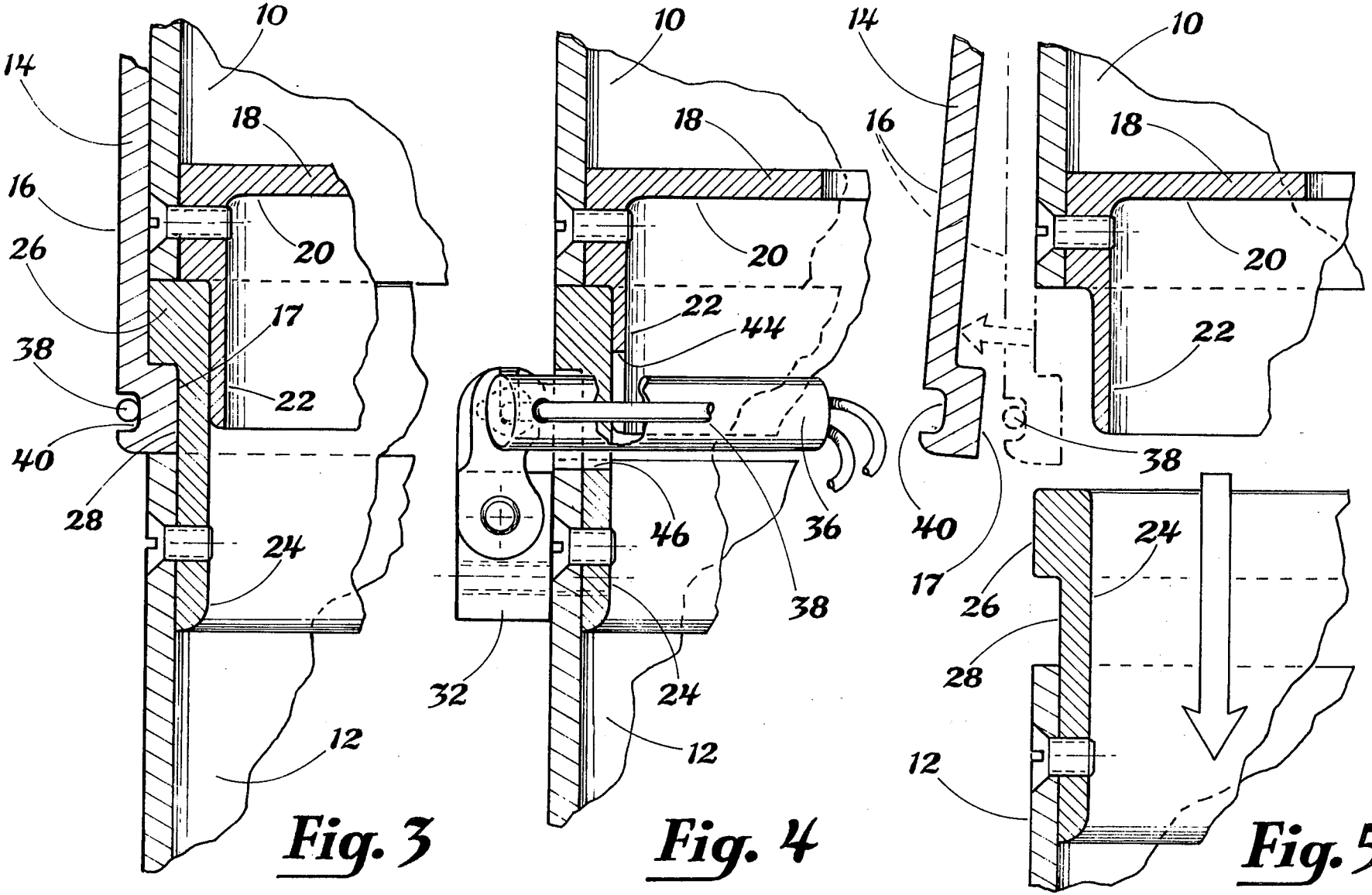
FIG. 3 is an enlarged fragmentary view, partly in section, of the fastening structure shown in FIG. 1 prior to release.
FIG. 4 is an enlarged fragmentary view, partly in section, of the structure of FIG. 1 at a different location on the periphery of the joined cylindrical members.
FIG. 5 is an enlarged fragmentary view, partly in section, of the structure shown in FIG. 3 subsequent to release.

Attached to the flange 20 by means of a bracket 34 is a conventional pyro device or squib which includes a cutting member placed in contact with a small diameter cable or wire rope 38. The fingers 16, in addition to having inwardly extending flanges 17, also are formed with small external grooves 40 for receiving the wire rope 38 which, when tightly tensioned around the finger members 16, cause the radially inwardly directed flange members 17 to be pressed into the annular groove 28 (FIG. 3). As shown in FIG. 1, the pyro device 36 which is wired to conductors 42 to an ignition device not forming a part of the present invention has just exploded, cutting the cable 38 and causing this cable to fly away from the side of cylindrical member 10 and grooves 40, thus permitting the spring fingers 16 to be released from groove 28. This is shown in FIG. 5, where the large arrow indicates that housing 12 and annular member 24 are moving downwardly relative to housing member 10 and showing fingers 16 moved outwardly in such manner that they are no longer carried in groove 28.

FIG. 4 is a view similar to FIG. 3 but taken at a location where the pyro device 36, which is fastened to member 22, projects through a notch 44 in the annular member 22 and outside the housing a sufficient distance that it can retain a length of the small wire rope 38. The squib 36 also extends through a notch 46 in the rim of member 24.

Enlarged and more detailed views of the structure for retaining and tensioning the wire rope 38 appear in FIGS. *2a* and *2b*. As shown in FIG. *2a*, the block 30 is mounted to the side wall of housing 12 and supports a threaded member 48 threadedly engaged with a ball retainer member 50 configured to receive and retain a ball 52 which is securely fastened to one end of the wire rope 38. From retainer 50 the wire rope 38 extends toward the left, entering a groove 40 in one of the several spring fingers 16 and continuing around the periphery of the assembled units in the grooves 40 and returning from the right side under the retainer 50, passing through the end of the squib 36 to a second ball retainer 54 which retains a ball 56 at the opposite end from ball 52. Ball retainer member 54 is secured to block 32 by means of threaded fasteners or other suitable securing means. With the arrangement shown in FIG. *2a*, it will be recognized that turning of the threaded member 48 makes it possible to tighten or loosen the cable member 38 as desired. Tightening of the cable 38 will cause the spring fingers 16 to be pressed firmly into the annular groove 28, thereby securing the two cylindrical housing members together.

FIG. *2b* shows the structure of FIG. *2a* as viewed from the top. In this view it will be clear that as the cable 38 proceeds to the left from ball retainer 50 it passes around the housing 12 and is overlapped by the opposite end coming from the right and feeding through the squib 36 into ball retainer 54. The squib 36, which is shown fastened to the flange 20 by means of bracket 34, serves to cut the cable 38, causing it to release the fingers 16 as previously described.

In securing the cylindrical housing members 10 and 12 together, it will be necessary to attach annular members 18 and 24 to cylindrical members 10 and 12 in such manner that the axially extending portion 22 of member 18 will telescope within the member 24. The arcuate members 14 including the spring fingers 16 are attached in the proper circumferential positions on housing 10 and axially in such manner that the inwardly extending projections or flanges of the fingers 16 will align with groove 28. The cable 38 is positioned with its retaining ball members 52 and 56 in the ball retainer members 50 and 54 with the cable 38 riding in the grooves 40 of fingers 16 around the periphery of the assembly.

It will be noted that, to accommodate overlap, grooves 40 or some of them may be made sufficiently wide to accommodate two layers of cable 38 which, of course, must also pass through the end of squib 36. As set forth above, the described assembly was devised for the purpose of joining and readily separating two cylindrical housings forming parts of an underwater deployment package including instrumentation in the lower housing 12 and cable and flotation means in the upper housing 10. For this reason, it was desired that when the assembly is deployed in the water, means responsive to pressure representing a desired depth will operate to fire the squib 36, thus cutting the wire rope 38 and releasing the fingers 16. This will cause the housing members 10 and 12 to separate as shown in FIGS. 1 and 5.

Those skilled in the art will recognize that a number of modificiations will be possible in connection with the invention heretofore described. Obviously, the numbers of spring fingers or arcuate members supporting the spring fingers will be controlled by the particular application. The number of fin members or other members bridging across from housing 12 to housing 10 may be other than three. Obviously, the location of the squib 36 and its mounting means is essentially a matter of convenience for any given installation. And while the means for tensioning cable 38 may be like that shown, other means which are well known in the art, including overcenter toggle devices, could well be suitable for given applications.

I claim:

1. Apparatus for fastening together a pair of cylindrical members having substantially the same diameter comprising a first annular member fastened to the inside surface near the end of one of said cylindrical members having a small flange extending radially outwardly to approximately the outside diameter of said cylindrical member, said flange being spaced from the end of said cylindrical member and cooperating therewith to define an annular groove;

a second annular member fastened to the inside surface of the adjoining end of the second of said cylindrical members, said second annular member including an axially extending flange of diameter just less than the inside diameter of said first annular member thereby permitting said first and second annular members to telescope together, said second annular member also including an inwardly extending radial flange;

a plurality of circumferentially spaced arcuate members fastened to the outside of said cylindrical member, said arcuate members each including a plurality of spring fingers extending beyond the end of said second cylindrical member and each of said fingers including a radially inwardly extending flange and a groove extending circumferentially on the outside of said fingers;

a small diameter wire rope positioned in the grooves of said fingers and tensioning means attached to one of said cylindrical members for tightening and securing said rope to cause said fingers to be forced into said annular groove, thereby locking said cylindrical members together; and an explosively actuated cutter attached to one of said cylindrical members for severing said wire rope to release said cylindrical members from each other.

2. Apparatus for fastening together a pair of cylindrical members as set forth in claim 1 wherein said tensioning and securing means comprises means enlarging the ends of said wire rope, a first supporting member fastened to the side of one of said cylindrical members for retaining one of said enlarged ends, a second supporting member fastened to the side of said one cylindrical member retaining the other of said enlarged ends, and threaded means forming part of one of said supporting members for tensioning said wire rope.

3. Apparatus for fastening together a pair of cylindrical members as set forth in claim 2 wherein said means enlarging the ends of said wire rope consists of ball members of significantly larger diameter than said wire rope.

4. Apparatus for fastening together a pair of cylindrical members as set forth in claim 1 wherein three said arcuate members are fastened to said cylindrical member and said arcuate members are spaced approximately 30° apart.

5. Apparatus for fastening together a pair of cylindrical members as set forth in claim 1 wherein the groove on said fingers is positioned at the outside of said radially inwardly extending flange.

6. Apparatus for fastening together a pair of cylindrical members as set forth in claim 1 wherein said wire rope when tensioned bridges across the space between said arcuate members and makes contact with the surface of the cylindrical member to which said tensioning means is fastened.

7. Apparatus for fastening together a pair of cylindrical members as set forth in claim 1 wherein said explosively actuated cutter is attached to said inwardly extending radial flange.

* * * * *